US005411364A

United States Patent [19]

Aberg et al.

[11] Patent Number: 5,411,364

[45] Date of Patent: May 2, 1995

[54] GAS TURBINE ENGINE FAILURE DETECTION SYSTEM

[75] Inventors: Robert O. Aberg; Stephen J. Hoeland, both of Phoenix, Ariz.

[73] Assignee: AlliedSignal Inc., Morris Township, Morris County, N.J.

[21] Appl. No.: 172,465

[22] Filed: Dec. 22, 1993

[51] Int. Cl.[6] ..... F01D 21/06

[52] U.S. Cl. ..... 415/9; 415/14; 415/118; 250/227.15

[58] Field of Search ..... 415/9, 14, 118; 416/2, 416/61; 250/227.15

[56] References Cited

U.S. PATENT DOCUMENTS

| | | | |
|---|---|---|---|
| 1,575,993 | 3/1926 | Johnson . | |
| 3,050,939 | 8/1962 | Morley . | |
| 3,159,166 | 12/1964 | Luedemann et al. . | |
| 3,164,368 | 1/1965 | Klein | 415/9 |
| 3,591,308 | 7/1971 | Blattner et al. | 415/9 |
| 3,612,710 | 10/1971 | Mount . | |
| 3,989,408 | 11/1976 | Jaegtnes . | |

FOREIGN PATENT DOCUMENTS

| | | | |
|---|---|---|---|
| 0040648 | 12/1981 | European Pat. Off. . | |
| 139150 | 12/1979 | Germany | 415/9 |
| 83612 | 5/1982 | Japan | 415/118 |
| 885572 | 11/1981 | U.S.S.R. | 415/14 |
| 1229563 | 5/1986 | U.S.S.R. | 415/9 |

*Primary Examiner*—Edward K. Look
*Assistant Examiner*—James A. Larson
*Attorney, Agent, or Firm*—James W. McFarland

[57] ABSTRACT

An electro optic sensor for sensing unwanted axial motion of the turbine of a gas turbine engine away from its normal position, includes a pair of fiber optic wave guides interconnected through a frangible member disposed axially adjacent the turbine rotor. Upon axial movement of the rotor away from its normal position, the frangible element is broken to open the optical circuit associated with the guides. Associated electronic circuitry generates an output signal indicative of failure of the gas turbine rotor.

17 Claims, 1 Drawing Sheet

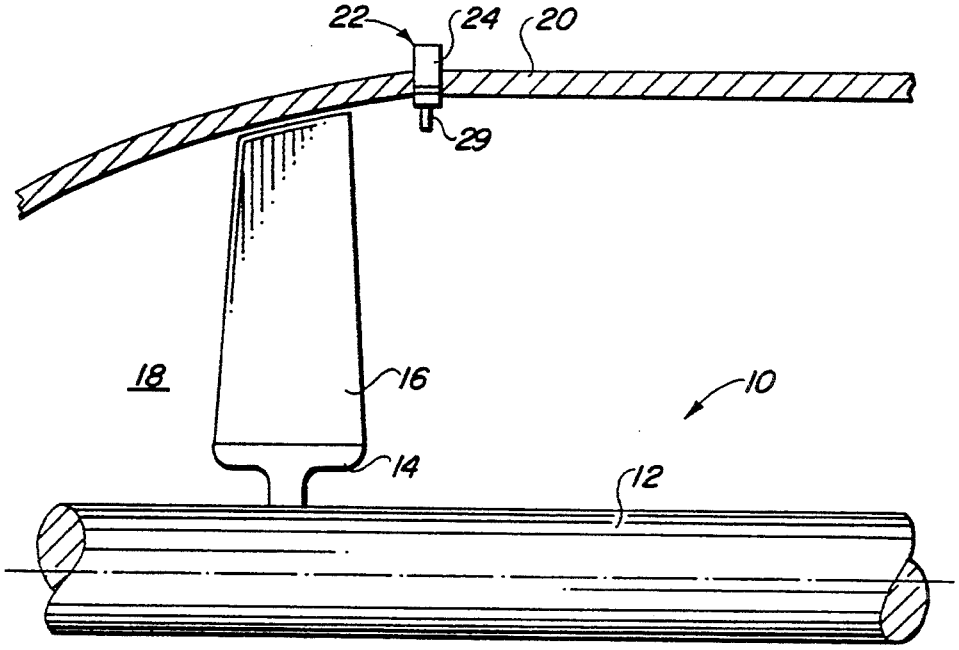
FIG. 1
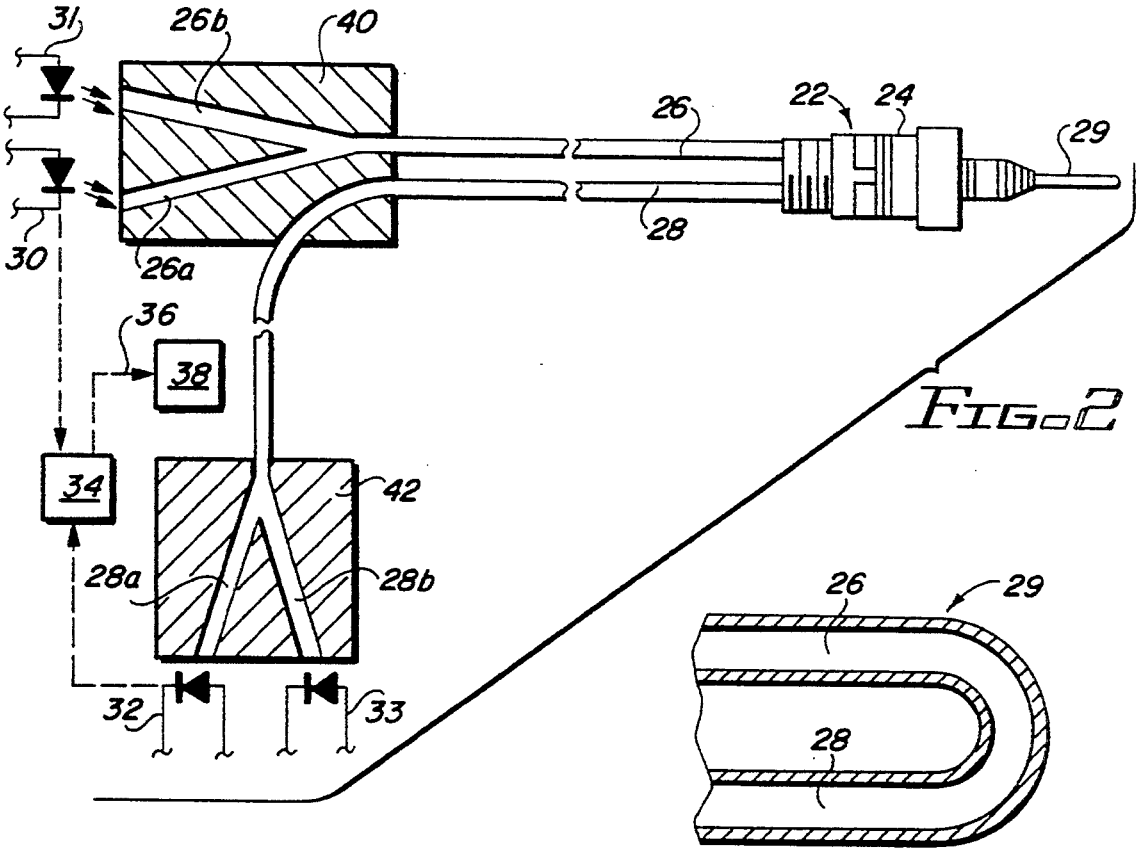
FIG. 2
FIG. 3

GAS TURBINE ENGINE FAILURE DETECTION SYSTEM

TECHNICAL FIELD

This invention pertains to turbomachinery, and pertains more particularly to gas turbine engines and apparatus for sensing failure in the gas turbine engine and thereupon disabling further operation of the engine.

BACKGROUND OF THE INVENTION

Turbomachinery include impellers or rotors rotating at very high speeds. For gas turbine engines such as utilized in aerospace applications including commercial aircraft, it is important to sense excess motion of such a rotor as it is indicative of an impending engine failure such as may be due to a bearing failure, imbalance, foreign object damage, or other reasons. It is important that such failure be detected as rapidly as possible, and that the detecting mechanism be reliable and not subject to inadvertent operation.

SUMMARY OF THE INVENTION

Accordingly it is an important object of the present invention to provide an improved sensor and associated system and apparatus for sensing unwanted motion of a rotor away from its normal position, which system is reliable, utilizes no moving parts, and is automatically operable to shut down further engine operation.

A more particular object of the present invention is to provide such a sensor system which utilizes a fiber optic circuit located closely adjacent to and disposed in the major air stream flow through the turbomachinery, associated light emitting and light receiving photo diodes, and electrical means for generating an output signal whenever the optical circuit is opened by virtue of motion of the rotor away from its normal axial position. Preferably, the output signal is delivered to the electronic control unit of the gas turbine engine to shut down further engine operation.

These and other objects and advantages of the present invention are specifically set forth in or will become apparent from the following detailed description of the preferred embodiment of the invention, when read in conjunction with the accompanying drawing.

BRIEF DESCRIPTION OF THE DRAWING

FIG. 1 is a schematic, partially cross-sectional plan view of the turbine section of a gas turbine engine incorporating the present invention;

FIG. 2 is a plan view of the sensor of the present invention in conjunction with schematic representations of the optical circuits and electrical circuits associated therewith; and FIG. 3 is a partial, enlarged cross-sectional plan view of the tip end of the sensor.

DETAILED DESCRIPTION OF THE PREFERRED EMBODIMENT

Referring now more particularly to the drawing, gas turbomachinery is illustrated in FIG. 1 in the form of a gas turbine engine 10 having a high speed rotating shaft 12. Mounted on shaft 12 is a turbine wheel or rotor 14 having associated conventional blading 16 thereon. Blading 16 is disposed in a major air flow path 18 through the engine such that rotor 14 is subject to axial thrust in the rightward direction as viewed in FIG. 1. A casing 20 is schematically illustrated in FIG. 1 and has a portion disposed closely to the outer tip of the blading 16.

The present invention further includes means for detecting axial movement of the turbine wheel 14 away from its normal axial position illustrated in FIG. 1, in the form of a sensor 22. Sensor 22 is located adjacent but slightly axially downstream of the rotor 14 in relation to the stream of gas flow passing across blades 16. Sensor 22 includes a metallic housing 24 rigidly secured to casing 20. Carried within housing 24 are a pair of fiber optic wave guides 26, 28. At the inner tip end, the wave guides 26, 28 extend through housing 24 and into the path 18 of the air flow within the gas turbine engine. As best depicted in FIG. 3 the wave guides 26, 28 are joined in a U-shaped configuration to present a frangible end tip element 29.

Optical wave guide 26 is connected to receive light in the visible blue spectrum from a blue light emitting diode 30, while the other optical wave guide 28 is connected to direct the visible blue light after its traversal of U-shaped frangible portion 29 to a light activated diode 32. The term "light activated diode" is used herein to refer to any light-sensitive device generating an electrical output. Phototransistors and photodiodes are exemplary of the type of such light-to-electrical transducers referred to. Resulting electrical signals from diodes 30, 32 are delivered through a conditioning circuit and signal output generator 34. The electronic circuit 34 generates an output signal delivered through connector 36 to an electronic control unit 38 of the gas turbine engine 10.

For purposes of redundancy, the wave guide 26 has a Y connector 40 presenting a pair of input wave guides **26*a* and 26*b* receiving the light respectively from the diode 30 and a second light emitting diode 31. Similarly, the wave guide 28 has a Y connector 42 communicating separate legs 28*a* and 28*b* to the light activated diode 32 and a second redundant light activated diode 33. For purposes of full redundancy the second diodes 31 and 33 may be connected through identical, redundant circuitry as illustrated in 34, 36, 38** to a second electronic control unit for the engine (not shown). This provides full redundancy of the control.

In operation, so long as the rotor 14 is in its appropriate axial position the U-shaped tip 29 completes the optical circuit between wave guides 26, 28 allowing a normal signal to be delivered to electronic control unit 38. Upon movement of turbine 14 axially, the tip end of the blades 16 promptly contact the U-shaped tip 29 which is composed of a frangible material. This tip end 29 breaks and thereby opens the optical circuit between wave guides 26 and 28. In response, the electronic circuit 34 changes the output signal to the electronic control unit 38 which is indicative of sensing the opening of the optical circuit. Preferably, the electronic control unit 38 responds to this output signal by disabling further operation of the gas turbine engine such as by automatically stopping further fuel flow to the engine.

Preferably, the light emitting diode 30 generates light in the visible blue spectrum so that the optical circuit of the present invention will not be affected by other radiation within the engine. In a gas turbine engine the primary radiation is in the red and infrared spectrum, emanating from the combustion process and high material temperature occurring therein.

From the foregoing it will be apparent that the present invention provides a fiber optic sensor that utilizes no moving pads but is effective to promptly sense unwanted axial motion of a turbine in a gas turbine engine to generate a control signal to disable further operation of the engine.

Various alterations and modifications to the foregoing will be apparent to those skilled in the ad. Accordingly the foregoing detailed description of a preferred embodiment of the invention should be considered exemplary in nature and not as limiting to the scope and spirit of the invention as set forth in the appended claims.

Having described the invention with sufficient clarity that those skilled in the art may make and use it, what is claimed is:

1. Gas turbomachinery comprising:

a casing:

a rotor journalled for rotation within the casing and having blading thereon disposed in momentum exchange relation with a flow of compressible fluid in the casing: and means for detecting axial movement of said rotor away from its normal position in the casing comprising a sensor housing having a pair of fiber optic wave guides therewithin, said wave guides extending outwardly from one end of said housing and being joined to complete an optical circuit and present a frangible element disposed axially adjacent said rotor to be contacted by said blading and open said optical circuit upon axial movement of said rotor away from its normal position, and light emitting and light activated diodes respectively connected to one and the other of said pair of wave guides.

2. Gas turbomachinery as set forth in claim 1, further including electronic means operably connected to said diodes and operable to generate an output signal upon opening of said optical circuit.

3. Gas turbomachinery as set forth in claim 2, further including a control responsive to said output signal to alter operation of said turbomachinery.

4. Gas turbomachinery as set forth in claim 3, wherein said control disables turbomachinery operation in response to said output signal.

5. Gas turbomachinery as set forth in claim 1, wherein said frangible element is generally U-shaped.

6. Gas turbomachinery as set forth in claim 5, wherein said frangible element is located axially adjacent and downstream of said rotor in relation to the flow of fluid past said rotor.

7. Gas turbomachinery as set forth in claim 1, wherein said light emitting diode emits visible blue light.

8. Gas turbomachinery as set forth in claim 1, wherein said rotor is a turbine wheel.

9. Gas turbomachinery as set forth in claim 8, wherein said turbomachinery comprises a gas turbine engine generating a hot gas flow and associated radiation therefrom in the red and infrared bands.

10. Gas turbomachinery as set forth in claim 9, wherein said light emitting diode emits visible blue light.

11. In a gas turbine engine having a casing, a rotor journalled for rotation within the casing, and blading on said rotor disposed in momentum exchange relation with a flow of compressible fluid in the casing to exert an axial thrust on the rotor; means for detecting axial movement of said rotor away from its normal position in the casing, comprising:

a sensor housing carried on said casing and having a pair of fiber optic wave guides therewithin, said wave guides extending outwardly from one end of said housing and being joined to complete an optical circuit and present a frangible element disposed axially adjacent said rotor to be contacted by said blading and open said optical circuit upon axial movement of said rotor away from its normal position; and light emitting and light activated diodes respectively connected to one and the other of said pair of wave guides.

12. In a gas turbine engine as set forth in claim 11, wherein said rotor is a turbine wheel.

13. In a gas turbine engine as set forth in claim 12, wherein said gas turbine engine generates a hot gas flow and associated radiation therefrom in the red and infrared bands.

14. In a gas turbine engine as set forth in claim 13, wherein said light emitting diode emits visible blue light.

15. In a gas turbine engine as set forth in claim 11, further including electronic means operably connected to said diodes for generating an output signal upon opening of said optical circuit.

16. In a gas turbine engine as set forth in claim 15, further including an engine control responsive to said output signal to alter operation of said engine.

17. In a gas turbine engine as set forth in claim 16, wherein said control disables engine operation in response to said output signal.

* * * * *